US009515436B2

(12) United States Patent
Kao et al.

(10) Patent No.: US 9,515,436 B2
(45) Date of Patent: Dec. 6, 2016

(54) USB TYPE-C ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Yang-Yang Zhou, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/950,471

(22) Filed: Nov. 24, 2015

(65) Prior Publication Data

US 2016/0156145 A1 Jun. 2, 2016

(30) Foreign Application Priority Data

Nov. 27, 2014 (CN) ..... 2014 1 0695820

(51) Int. Cl.

| | |
|---|---|
| ***H01R 13/648*** | (2006.01) |
| ***H01R 24/60*** | (2011.01) |
| ***H01R 12/72*** | (2011.01) |
| ***H01R 13/436*** | (2006.01) |
| ***H01R 13/502*** | (2006.01) |
| *H01R 107/00* | (2006.01) |
| *H01R 13/514* | (2006.01) |
| *H01R 13/504* | (2006.01) |

(Continued)

(52) U.S. Cl.

CPC ..... *H01R 24/60* (2013.01); *H01R 12/721* (2013.01); *H01R 13/4361* (2013.01); *H01R 13/502* (2013.01); *H01R 13/504* (2013.01); *H01R 13/514* (2013.01); *H01R 13/6581* (2013.01); *H01R 13/6593* (2013.01); *H01R 2107/00* (2013.01)

(58) Field of Classification Search

USPC ..... 439/607.55

See application file for complete search history.

(56) References Cited

U.S. PATENT DOCUMENTS 7,252,548 B2 * 8/2007 Huang ..... H01R 13/65802 439/607.01

7,540,786 B1 * 6/2009 Koser ..... H01R 13/405 439/660

(Continued)

*Primary Examiner* — Tho D Ta

(74) *Attorney, Agent, or Firm* — Muncy, Geissler, Olds & Lowe, P.C.

(57) ABSTRACT

An electrical plug connector includes an insulated housing, a plurality of upper-row plug terminals, a plurality of lower-row plug terminals, and a rear terminal organizer. The insulated housing includes a rear assembling portion defined at the rear of the insulated housing. The rear terminal organizer is assembled to the rear of the insulated housing. The rear terminal organizer includes a plurality of through holes and a buckling portion. The through holes are defined through the rear terminal organizer from the front to the rear. The rear of the upper-row plug terminals and the rear of the lower-row plug terminals respectively pass through the through holes. The buckling portion is defined at the front of the rear terminal organizer. The buckling portion is adapted to be mated and engaged with the rear assembling portion.

16 Claims, 9 Drawing Sheets

(51) Int. Cl.
*H01R 13/6593* (2011.01)
*H01R 13/6581* (2011.01)

(56) References Cited

U.S. PATENT DOCUMENTS

| | | | | |
|---|---|---|---|---|
| 7,695,318 | B1 * | 4/2010 | Wang | H01R 24/60 439/607.01 |
| 7,862,378 | B1 * | 1/2011 | Wan | H01R 13/506 439/607.35 |
| 2011/0281464 | A1 * | 11/2011 | Hou | H01R 13/6593 439/607.55 |
| 2011/0281465 | A1 * | 11/2011 | Hou | H01R 13/6581 439/607.55 |
| 2015/0270646 | A1 * | 9/2015 | Kao | H01R 13/6581 439/76.1 |
| 2015/0270659 | A1 * | 9/2015 | Kao | H01R 24/64 439/607.01 |

* cited by examiner

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

151

152

FIG.1C

USB TYPE-C ELECTRICAL PLUG CONNECTOR

CROSS-REFERENCES TO RELATED APPLICATIONS

This non-provisional application claims priority under 35 U.S.C. §119(a) on Patent Application No. 201410695820.7 filed in China, P.R.C. on 2014 Nov. 27, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

An existing USB electrical plug connector includes an insulated housing, a plurality of terminals, and a rear base. In assembly, firstly the terminals are assembled in the insulated housing, and then the rear base is assembled to the insulated housing, so that the legs of the terminals can be exposed from the rear of the rear base and soldered with a circuit board.

Generally, during a bending test of an existing electrical plug connector, a bending force is applied between the insulated housing and the rear base of the existing electrical plug connector. Since the existing connector is devoid of any bending-resistant structures between the insulated housing and the rear base, the assembly of the insulated housing and the rear base is bent so that the insulated housing is detached from the rear base, resulting in the terminals being bent and detached from the insulated housing and the rear base. Therefore, defective products would be manufactured.

SUMMARY OF THE INVENTION

Consequently, how to improve the existing electrical plug connector becomes an issue.

In view of this, an exemplary embodiment of the instant disclosure provides an electrical plug connector comprising a metallic shell, an insulated housing, a plurality of upper-row plug terminals, a plurality of lower-row plug terminals, and a rear terminal organizer. The metallic shell defines a receiving cavity therein. The insulated housing is received in the receiving cavity and comprises an upper portion, a lower portion, a mating room, and a rear assembling portion. The upper portion has an upper mating face, the lower portion has a lower mating face, and the upper mating face faces the lower mating face. The mating room is defined at the front of the insulated housing and between the upper portion and the lower portion. The rear assembling portion is defined at the rear of the insulated housing. The upper-row plug terminals comprise a plurality of upper signal pairs for signal transmission, at least one power terminal, and at least one ground terminal. The upper-row plug terminals are held in the upper portion of the insulated housing and partly exposed upon the upper mating face of the upper portion. The lower-row plug terminals comprise a plurality of lower signal pairs for signal transmission, at least one power terminal, and at least ground terminal. The lower-row plug terminals are held in the lower portion of the insulated housing and partly exposed upon the lower mating face of the lower portion. The rear terminal organizer is assembled to the rear of the insulated housing. The rear terminal organizer comprises a plurality of through holes and a buckling portion. The through holes are defined through the rear terminal organizer from the front to the rear. The rear of the upper-row plug terminals and the rear of the lower-row plug terminals respectively pass through the through holes. The buckling portion is defined at the front of the rear terminal organizer, and the buckling portion is adapted to be mated and engaged with the rear assembling portion.

Based on the above, by the structural mating and size mating between the rear assembling portion of insulated housing and the buckling portion of the rear terminal organizer, the fixation between the rear assembling portion and the buckling portion can be further improved. As a result, the insulated housing would not detach from the rear terminal organizer easily when a bending test is applied to the electrical plug connector, and the tail portions of the upper-row plug terminals and the tail portions of the lower-row plug terminals would not detach from the through holes of the rear terminal organizer. Consequently, the fixing between the insulated housing and the rear terminal organizer and the structural strength of the electrical plug connector can be improved efficiently. Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 1C illustrates a schematic configuration diagram of plug terminals of the electrical plug connector shown in FIG. 1B;

DETAILED DESCRIPTION

Figure 1:
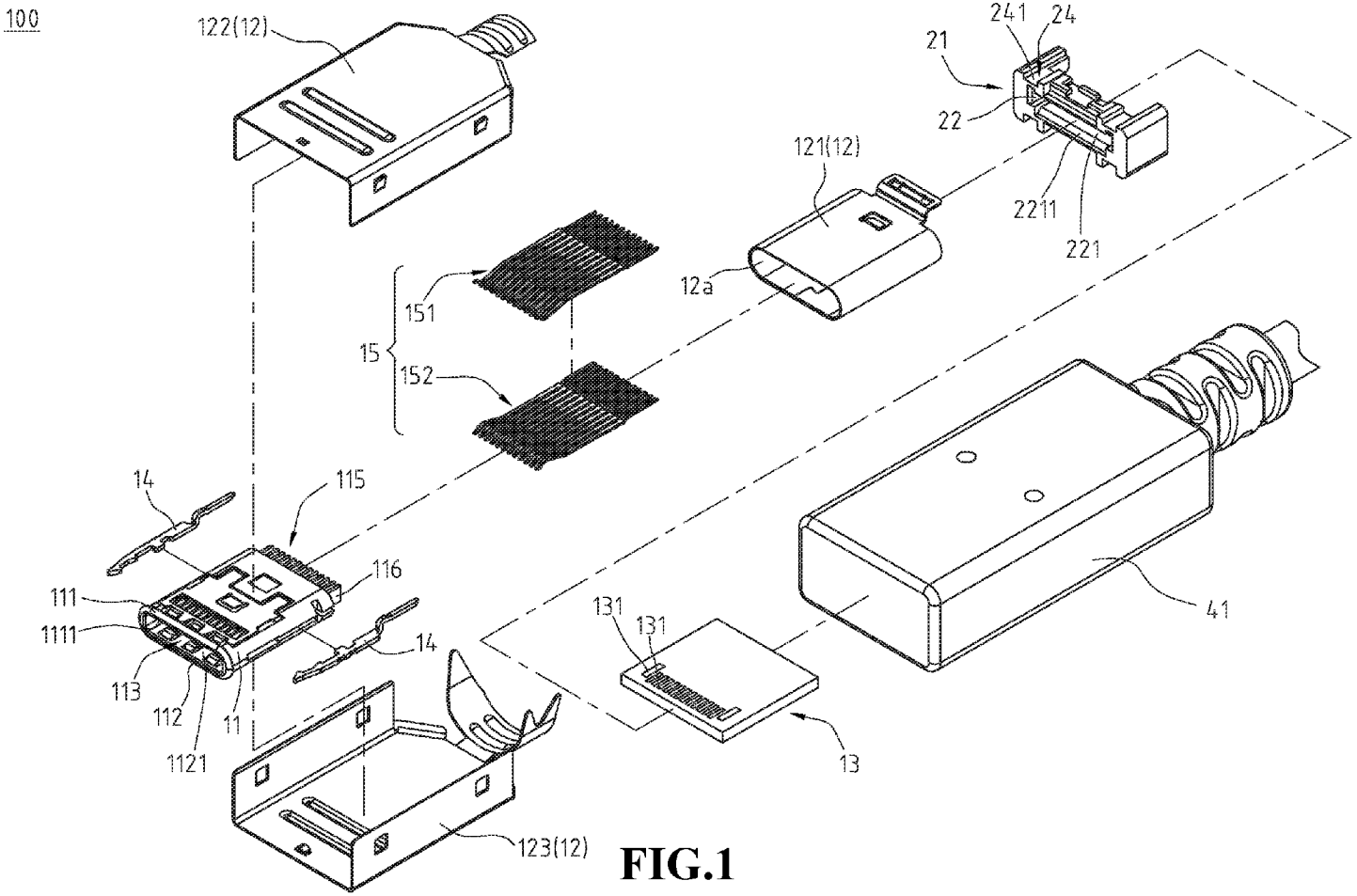
FIG. 1 illustrates an exploded view of an electrical plug connector according to an exemplary embodiment of the instant disclosure.
Figure 2:
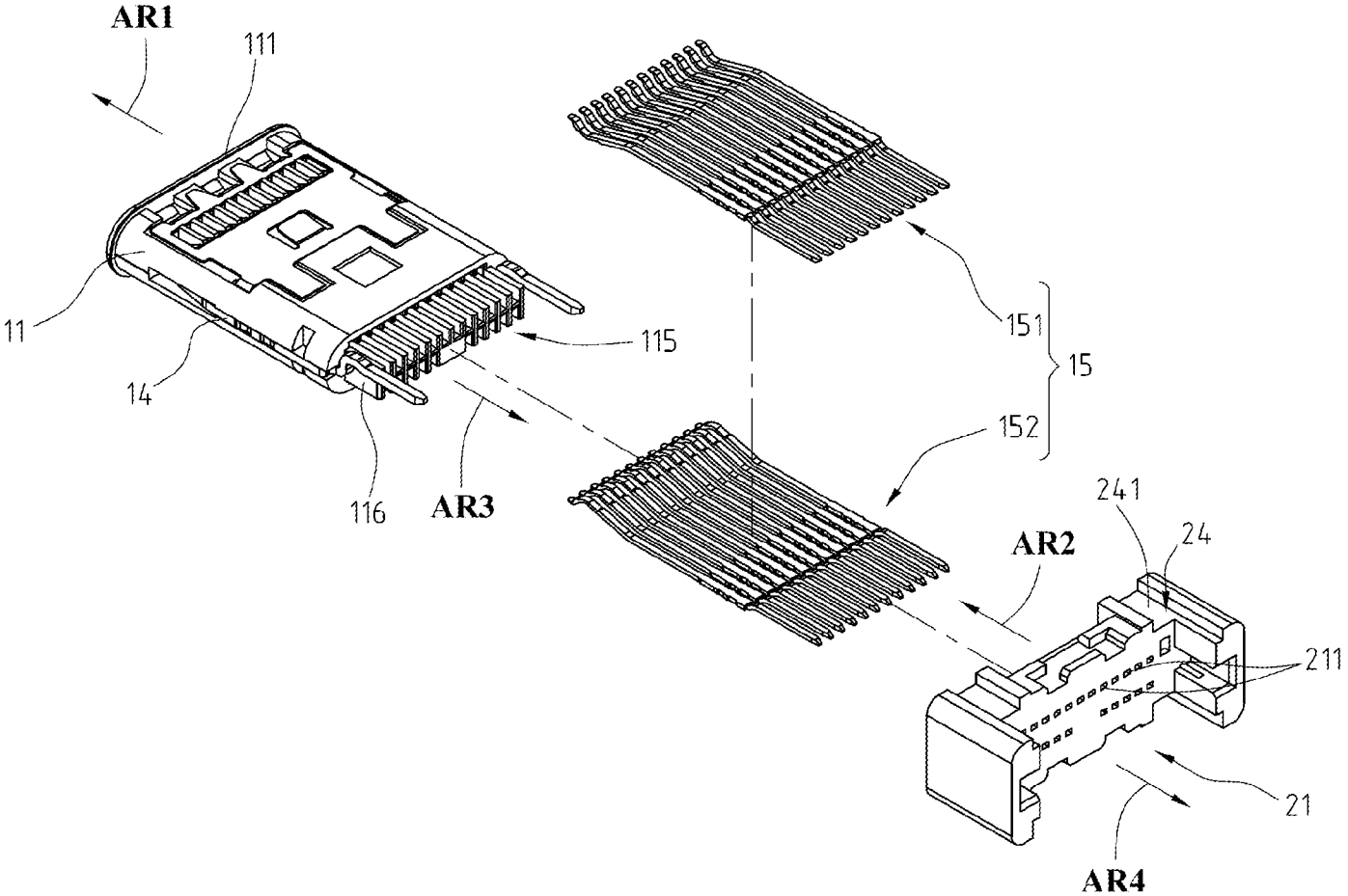
FIG. 2 illustrates an exploded view from the bottom showing a rear terminal organizer is assembled with an assembly of an insulated housing and plug terminals of the electrical plug connector of FIG. 1.
Figure 3A:
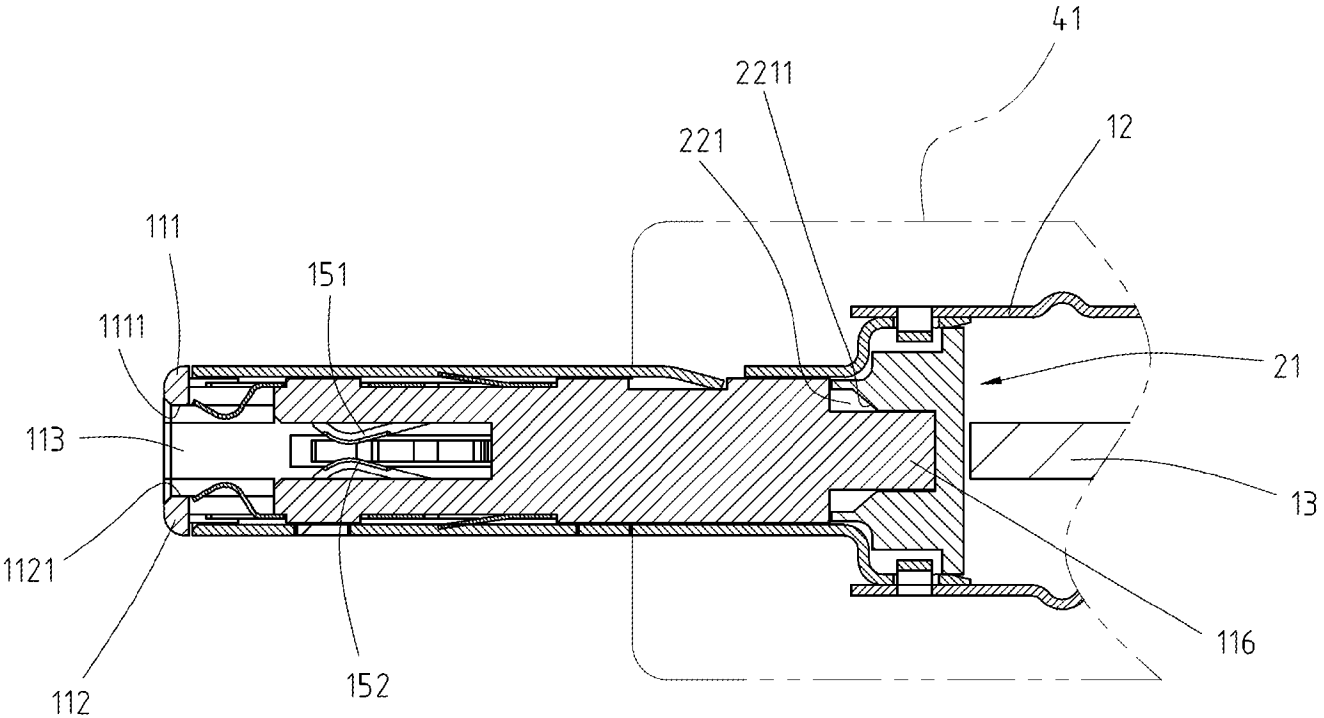
FIG. 3A illustrates a side sectional view of the electrical plug connector according to a first embodiment of the instant disclosure.

Please refer to FIG. 1, FIG. 2, and FIG. 3A, which illustrate an electrical plug connector of an exemplary embodiment according to the instant disclosure. FIG. 1 illustrates an exploded view of an electrical plug connector 100 of an exemplary embodiment. FIG. 2 illustrates an exploded view from the bottom showing a rear terminal organizer 21 is assembled with an assembly of an insulated housing 11 and plug terminals 15 of the electrical plug connector 100 of FIG. 1. FIG. 3A illustrates a side sectional view of the electrical plug connector 10 according to a first embodiment of the instant disclosure. In this embodiment, the electrical plug connector 100 can provide a reversible or dual orientation USB Type-C connector interface and pin assignments, i.e., a USB Type-C plug connector. In this embodiment, the electrical plug connector 100 comprises an insulated housing 11, a plurality of plug terminals 15, a metallic shell 12, and a rear terminal organizer 21. Furthermore, the electrical plug connector 100 comprises a circuit board 13, a wire, and a metallic shell 41.

Please refer to FIG. 1, FIG. 2, and FIG. 3A. The insulated housing 11 is an elongate plate and comprises an upper portion 111, a lower portion 112, a mating room 113, and a rear assembling portion 115. Here, the upper portion 111 and the lower portion 112 of the insulated housing 11 are respectively injection molded or the like. The mating room 113 is defined at the front of the insulated housing 11. The front of the insulated housing 11 defines as an inserting part for being inserted into an electrical receptacle connector, while the rear of the insulated housing 11 defines a positioning part and opposite to the inserting part. The facing direction AR2 of the front of the rear terminal organizer 21 is the same as the facing direction AR1 of the front of the insulated housing 11, and the facing direction AR4 of the rear of the rear terminal organizer 21 is the same as the facing direction AR3 of the rear of the insulated housing 11, as shown in FIG. 2. In addition, the mating room 113 is defined between the upper portion 111 and the lower portion 112. In this embodiment, the rear assembling portion 115 is formed at the rear of the insulated housing 11. The rear assembling portion 115 may be, but not limited to, a protruded block 116 extended outward from the rear of the insulated housing 11. Moreover, the upper portion 111 has an upper mating face 1111, the lower portion 112 has a lower mating face 1121, and the upper mating face 1111 is faced toward the lower mating face 1121.

Figure 1A:
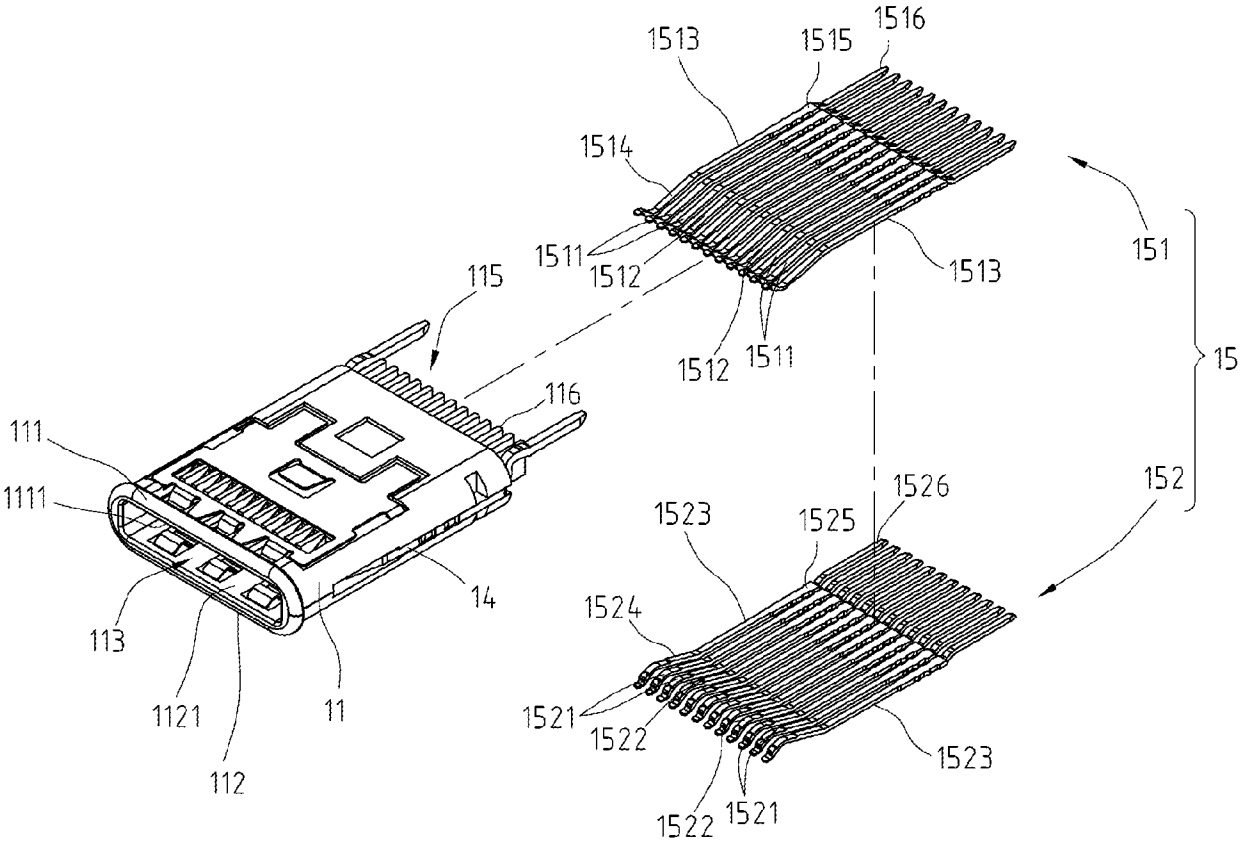
FIG. 1A illustrates a partial exploded view of the electrical plug connector of FIG. 1.
Figure 1B:
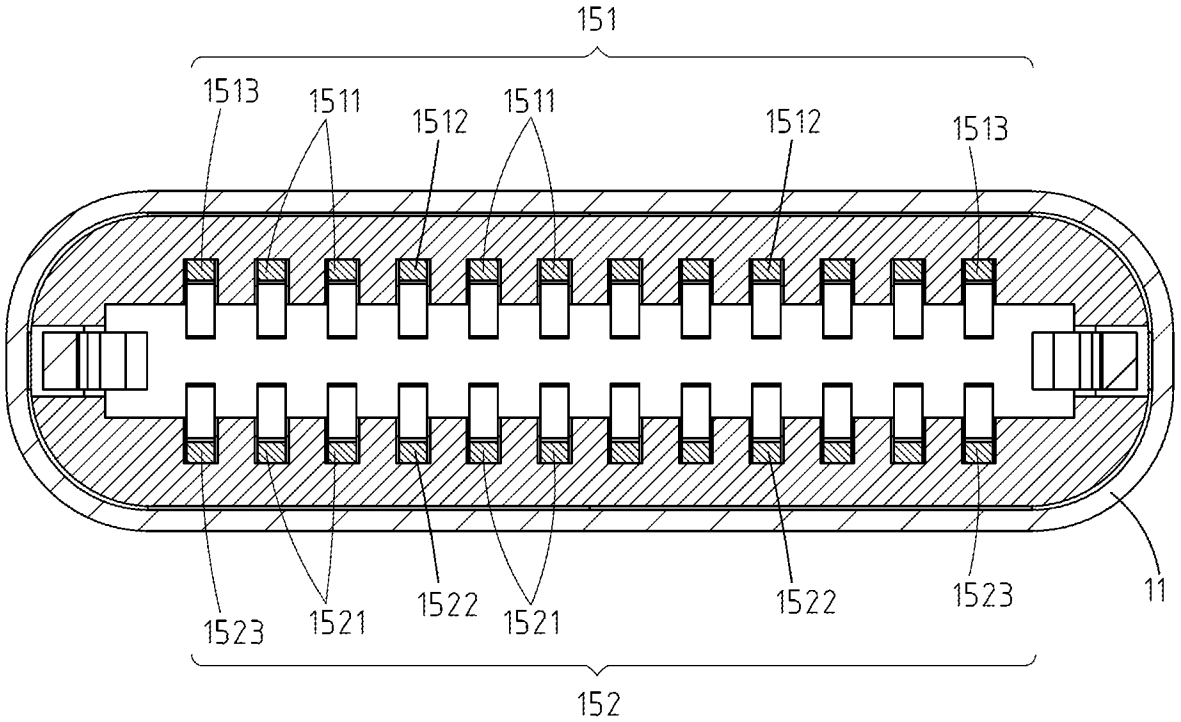
FIG. 1B illustrates a front sectional view of the electrical plug connector of the exemplary embodiment.

Please refer to FIG. 1A and FIG. 1B. The plug terminals 15 are configured in the upper portion 111 and the lower portion 112. The plug terminals 15 comprise a plurality of upper-row plug terminals 151 and a plurality of lower-row plug terminals 152.

Please refer to FIG. 1A, FIG. 1B, FIG. 1C, and FIG. 3A. The upper-row plug terminals 151 are held in the upper portion 111 of the insulated housing 11 and partly exposed upon the upper mating face 1111 of the upper portion 111. Here, the upper-row plug terminals 151 comprise a plurality of upper signal pairs 1511 for signal transmission, at least one power terminal 1512, and at least one ground terminal 1513. Specifically, as depicted in FIG. 1C, the upper-row plug terminals 151 comprise, from right to left, a ground terminal 1513 (Gnd), a first upper signal pair (TX1+−) 1511, a second upper signal pair (D+−) 1511, a third upper signal pair (RX2+−) 1511, two power terminals 1512 (Power/VBUS) between the three pairs of upper signal pairs 1511, a retain terminal (RFU), (the retain terminal and a configuration channel 1 (CC1) are respectively arranged between the power terminals 1512 and the second upper signal pair (D+−) 1511), and a ground terminal 1513 (Gnd) at the leftmost.

Figure 4:
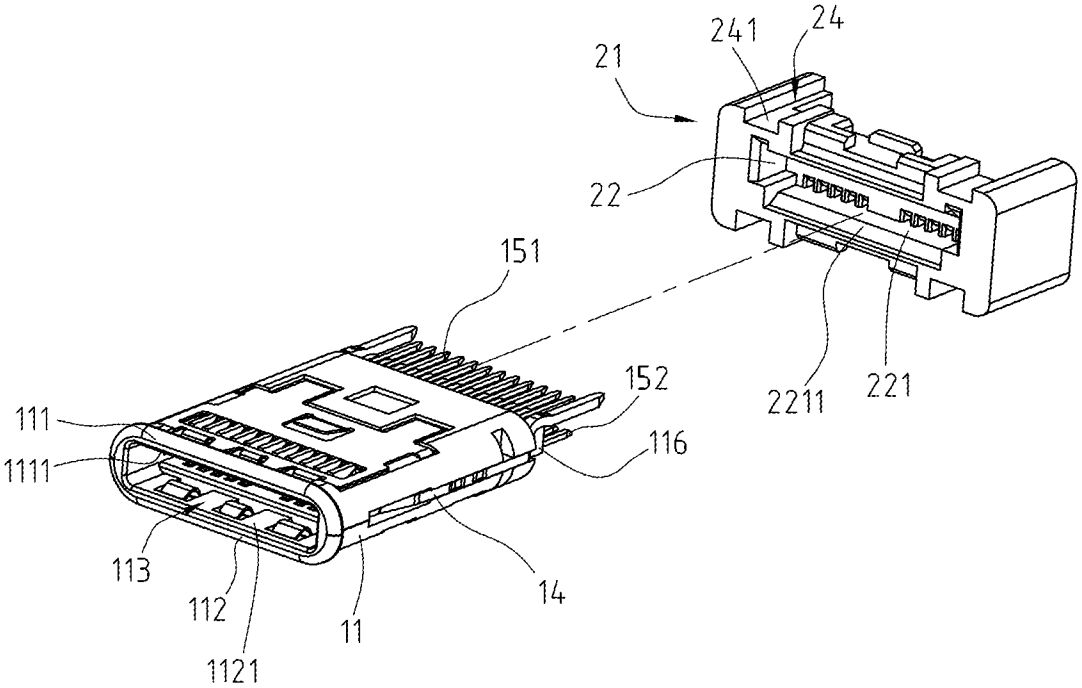
FIG. 4 illustrates an exploded view from the top showing the insulated housing is assembled with the rear terminal organizer of the electrical plug connector of FIG. 1.

Please refer to FIG. 1A, FIG. 1B, FIG. 1C, and FIG. 3A. Each of the upper-row plug terminals 151 comprises a flexible contact portion 1514, a body portion 1515, and a tail portion 1516. For each of the upper-row plug terminals 151, the body portion 1515 is held in the upper portion 111, the flexible contact portion 1514 is extended forward from the body portion 1515 in the rear-to-front direction and partly exposed upon the upper mating face 1111 of the upper portion 111, and the tail portion 1516 is extended backward from the body portion 1515 in the front-to-rear direction and protruded from the insulated housing 11. The upper signal pairs 1511 partly project into the mating room 113 and are provided for transmitting first signals (i.e., USB 3.0 signals.). The tail portions 1516 of the upper-row plug terminals 151 are extended from the rear of the insulated housing 11 and aligned horizontally to form flat legs, named SMT legs which can be soldered or mounted on the surface of a circuit board using surface mount technology, as shown in FIG. 4.

Please refer to FIG. 1A, FIG. 1B, FIG. 1C, and FIG. 3A. The lower-row plug terminals 152 are held in the lower portion 112 of the insulated housing 11 and partly exposed upon the lower mating face 1121 of the lower portion 112. Here, the lower-row plug terminals 152 comprise a plurality of lower signal pairs 1521 for signal transmission, at least one power terminal 1522, and at least one ground terminal 1523. Specifically, as shown in FIG. 1C, the lower-row plug terminals 152 comprise, from left to right, a ground terminal 1523 (Gnd), a first lower signal pair (TX2+−) 1521, a second lower signal pair (D+−) 1521, a third lower signal pair (RX1+−) 1521, two power terminals 1522 (Power/VBUS) between the three pairs of lower signal pairs 1521, a retain terminal (RFU), (the retain terminal and a configuration channel 2 (CC2) are respectively arranged between the power terminals 1522 and the second lower signal pair (D+−) 1521), and a ground terminal 1523 (Gnd) at the rightmost.

Please refer to FIG. 1A, FIG. 1B, FIG. 1C, and FIG. 3A. Each of the lower-row plug terminals 152 comprises a flexible contact portion 1524, a body portion 1525, and a tail portion 1526. For each of the lower-row plug terminals 152, the body portion 1525 is held in the lower portion 112, the flexible contact portion 1524 is extended forward from the body portion 1525 in the rear-to-front direction and partly exposed upon the lower mating face 1121 of the lower portion 112, and the tail portion 1526 is extended backward from the body portion 1525 in the front-to-rear direction and protruded from the insulated housing 11. The lower signal pairs 1521 partly project into the mating room 113 and are provided for transmitting second signals (i.e., USB 3.0 signals). The tail portions 1526 of the lower-row plug terminals 152 are extended from the rear of the insulated housing 11 and aligned horizontally to form flat legs, named SMT legs which can be soldered or mounted on the surface of a circuit board using surface mount technology, as shown in FIG. 2.

Please refer to FIG. 1A, FIG. 1B, FIG. 1C, and FIG. 3A. It is understood that, in this embodiment, the upper-row plug terminals 151 and the lower-row plug terminals 152 are respectively at the upper mating face 1111 of the upper portion 111 and the lower mating face 1121 of the lower portion 112. Additionally, pin-assignments of the upper-row plug terminals 151 and the lower-row plug terminals 152 are point-symmetrical with a central point of a receiving cavity 12*a* of the metallic shell 12 as the symmetrical center. Here, point-symmetry means that after the upper-row plug terminals 151 (or the lower-row plug terminals 152), are rotated by 180 degrees with the symmetrical center as the rotating center, the upper-row plug terminals 151 and the lower-row plug terminals 152 are overlapped. That is, the rotated upper-row plug terminals 151 are arranged at the position of the original lower-row plug terminals 152, and the rotated lower-row plug terminals 152 are arranged at the position of the original upper-row plug terminals 151. Accordingly, the electrical plug connector 100 can have a 180 degree symmetrical, dual or double orientation design and pin assignments which enables the electrical plug connector 100 to be inserted into a corresponding receptacle connector in either of two intuitive orientations, i.e. in either upside-up or upside-down directions. In other words, the upper-row plug terminals 151 and the lower-row plug terminals 152 are arranged upside down, and the pin assignment of the upper-row plug terminals 151 is left-right reversal with respect to that of the lower-row plug terminals 152. Accordingly, the electrical plug connector 100 is inserted into an electrical receptacle connector with a first orientation where the lower mating face 1121 of the lower portion 112 is facing up, for transmitting first signals. Conversely, the electrical plug connector 100 is inserted into the electrical receptacle connector with a second orientation where the lower mating face 1121 of the lower portion 112 is facing down, for transmitting second signals. Furthermore, the specification for transmitting the first signals is conformed to the specification for transmitting the second signals. Note that, the inserting orientation of the electrical plug connector 100 is not limited by the instant disclosure.

Please refer to FIG. 1A, FIG. 1B, FIG. 1C, and FIG. 3A. The position of the upper-row plug terminals 151 correspond to the position of the lower-row plug terminals 152.

Please refer to FIG. 1, FIG. 1B, and FIG. 3A. The metallic shell 12 is hollowed and defines a receiving cavity 12*a* therein. The receiving cavity 12*a* is adapted to receive and enclose the insulated housing 11. In this embodiment, the metallic shell 12 is a multi-piece member, for example, the metal shell 12 includes a main shell 121, an upper half metallic shell 122 and a lower half metallic shell 123, but embodiments are not limited thereto. Alternatively, in some embodiments, the metallic shell 12 may be formed by bending a unitary member.

Please refer to FIG. 1, FIG. 2, FIG. 3A, and FIG. 4. In this embodiment, the rear terminal organizer 21 is assembled to the rear of the insulated housing 11. The rear terminal organizer 21 comprises a plurality of through holes 211, a buckling portion 22, and at least one gluing passage 24.

The through holes 211 are defined through the rear terminal organizer 21, from the front to the rear. The rear of the upper-row plug terminals 151 and the rear of the lower-row plug terminals 152 are exposed from the rear of the insulated housing 11. Moreover, when the rear terminal organizer 21 is assembled to the rear of the insulated housing 11, the rear of the upper-row plug terminals 151 and the rear of the lower-row plug terminals 152 pass through the through holes 211, respectively.

Figure 3B:
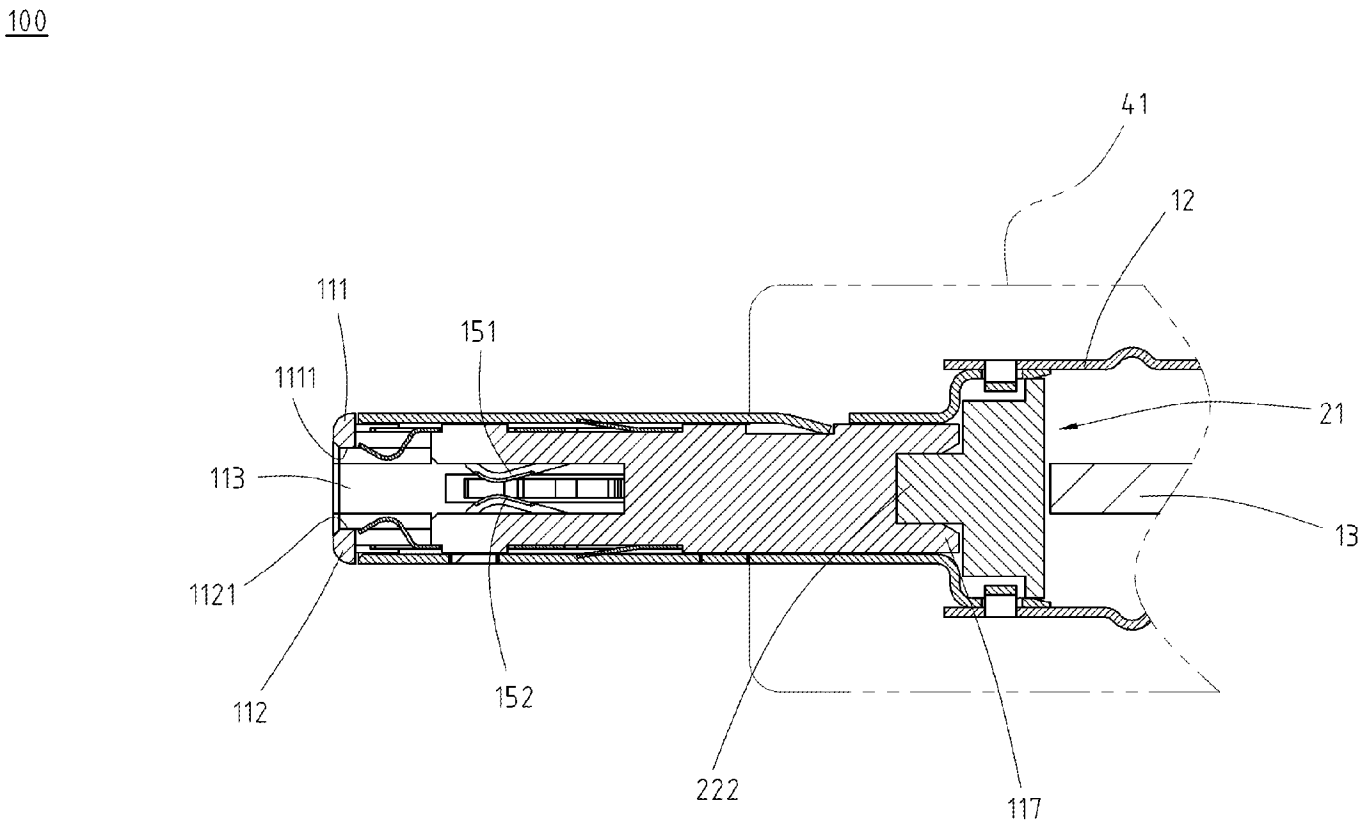
FIG. 3B illustrates a side sectional view of the electrical plug connector according to a second embodiment of the instant disclosure.

The buckling portion 22 is formed at the front of the rear terminal organizer 21. The buckling portion 22 is mated with the rear assembling portion 115 and adapted to be engaged with the rear assembling portion 115. In this embodiment, the buckling portion 22 is a recessed groove 221, but embodiments are not limited thereto. In addition, as mentioned the rear assembling portion 115 may be a protruded block 116, and the protruded block 116 is to be engaged in the recessed groove 221. In this embodiment, the buckling portion 22 comprises a plurality of guiding inclined surfaces 2211 defined around the periphery thereof. The guiding inclined surfaces 2211 are provided for guiding the assembling between the insulated housing 11 and the rear terminal organizer 21. In other words, when the buckling portion 22 is to be assembled with the rear assembling portion 115, the guiding inclined surfaces 2211 guide the protruded block 116 to be assembled in the recessed groove 221 conveniently. Additionally, in some embodiments, the rear assembling portion 115 may be formed as an engaging groove 117, and the buckling portion 22 may be an engaging block 222, as shown in FIG. 3B. The size of the engaging groove 117 mates with the size of the engaging block 222, such that the engaging block 222 can be engaged in the engaging groove 117. In other words, the buckling portion 22 and the rear assembling portion 115 may have correspondingly mating structures like protrusions and corresponding recesses, so that the mating structures can be mated with each other. Moreover, the width of the rear assembling portion 115 is substantially equal to the width of the buckling portion 22. As a result, when the buckling portion 22 is assembled with the rear assembling portion 115, the buckling portion 22 is securely positioned with the rear assembling portion 115.

The gluing passage 24 is formed at a peripheral area of the rear terminal organizer 21, and the gluing passage 24 is defined through the rear terminal organizer 21 from the front to the rear. In this embodiment, the rear terminal organizer 21 defines a plurality of gluing passages 24, and the gluing passages 24 are formed at two sidewalls of the rear terminal organizer 21. In addition, the gluing passages 24 respectively define groove structures 241, and the groove structures 241 are located at two sides of the top surface of the rear terminal organizer 21 and two sides of the bottom surface of the rear terminal organizer 21. In other words, the two sides of the top surface of the rear terminal organizer 21 and the two sides of the bottom surface of the rear terminal organizer 21 are recessed to form the groove structures 241, but embodiments are not limited thereto. In some embodiments, the gluing passages 24 may be formed at a right sidewall and a left sidewall of the rear terminal organizer 21. In addition, the gluing passage 24 may be formed as one or more through-hole structure and defined through the rear terminal organizer 21. That is, the groove structures 241 may be replaced by the through-hole structures for filling plastic material therethrough.

The electrical plug connector 100 further comprises a covering member. The covering member is extended from the rear of the rear terminal organizer 21, through the gluing passage 24, and extended toward the rear of the metallic shell 12. The covering member 31 covers the wire, the tail portions 1516 of the upper-row plug terminals 151, and the tail portions 1526 of the lower-row plug terminals 152. In this embodiment, after the wires are soldered with the circuit board 13, the circuit board 13 may be assembled with the covering member 31 by means of glue dispensing, over molding, or the like. The covering member is formed by filling plastic materials (glues) into the electrical plug connector 100 from the rear of the rear terminal organizer 21 (i.e., from the rear of the circuit board 13), and the glue is Polyethylene (PE). After the gluing process, the glue flows to the rear of the metallic shell 12 through the gluing passage 24. The size and the position of the glue structure (i.e., the crude product of the covering member) can be confined by a fixture, so that the glue structure is formed (fixed) around the circuit board 13 and extended through the gluing passage 24 to the rear of the metallic shell 12. Therefore, the fixed glue structure (i.e., the covering member) can protect the wires, the tail portions 1516 of the upper-row plug terminals 151, and the tail portions 1526 of the lower-row plug terminals 152 soldered on the circuit board 13. Furthermore, an insulated shell 41 is further formed out of the covering member by means of over molding, and the insulated shell 41 is made of polyvinylchloride (PVC). Accordingly, by covering the covering member with the insulated shell 41, an electrical plug connector 100 having transmission wires can be provided. When a covering member is further applied to the electrical plug connector 100, the covering member covers the wires or covers the tail portions 1516 of the upper-row plug terminals 151 and the tail portions 1526 of the lower-row plug terminals 152. Therefore, during the formation of the insulated shell 41, the wires and the tail portions 1516, 1526 can be prevented from being shifted, tilted, or deformed upon suffering impact.

Figure 5:
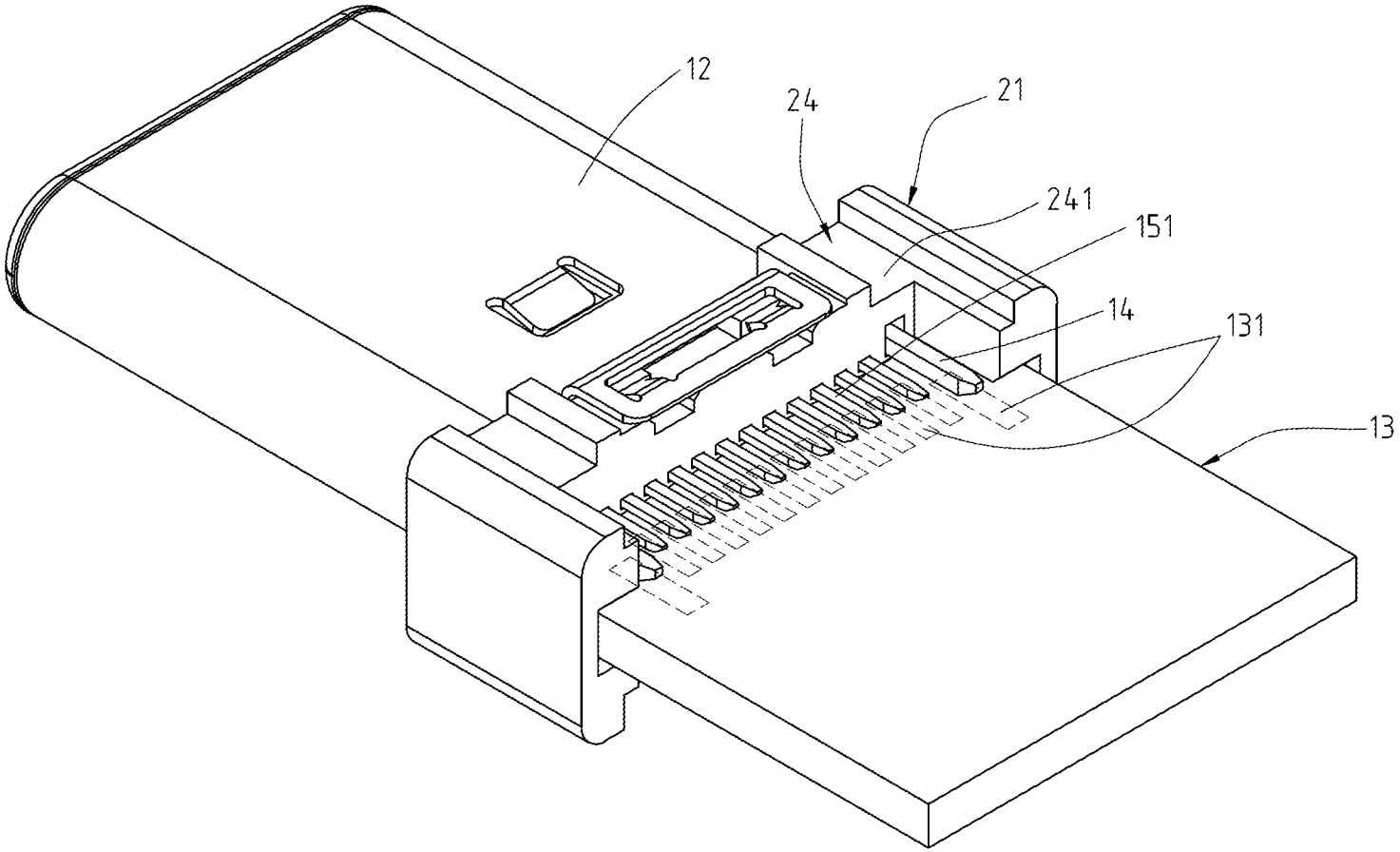
FIG. 5 illustrates a schematic perspective view of the electrical plug connector assembled with a circuit board.

Please refer to FIG. 1 and FIG. 5. The circuit board 13 is located at the rear of the rear terminal organizer 21 and has a plurality of contacts 131. The contacts 131 comprise a plurality of ground contacts and a plurality of terminal contacts. The ground contacts and the terminal contacts are configured at one side of the circuit board 13. The terminal contacts are located between the ground contacts. The tail portions 1516 of the upper-row plug terminals 151 and the tail portions 1526 of the lower-row plug terminals 152 are respectively soldered with the terminal contacts.

Please refer to FIG. 1 and FIG. 2. The electrical plug connector 100 further comprises a ground leg 14. The ground leg 14 may be, but not limited to, formed by blanking technique. In some embodiments, the ground leg 14 may be formed by stamping technique. It is understood that the structural strength of the ground leg 14 formed by blanking technique is greater than that of the ground leg 14 formed by stamping technique. The ground leg 14 is configured at the insulated housing 11 and in contact with the metallic shell 12. The ground leg 14 comprises a plurality of side arms, a plurality of hook portions, and a plurality of leg portions. The side arms are of elongated shaped, and the side arms are adapted to be received in grooves at the sidewalls of the insulated housing 11. Each of the hook portions is extended from the front of the corresponding side arm toward the mating room 113, and the hook portions are partly projected into the mating room 113. Each of the leg portions is extended from the rear of the corresponding side arm. Each of the leg portions is protruded from the rear of the corresponding groove and exposed out of the insulated housing 11, and the leg portions are further extended to the circuit board 13 to be soldered with the ground contacts 131.

When the electrical plug connector 100 is mated with an electrical receptacle connector, the hook portions of the ground leg 14 are engaged with engaging portions of the electrical receptacle connector, so that the hook portions would not wear against two sides of a tongue portion of the electrical receptacle connector to damage the tongue portion. Additionally, the ground leg 14 of the electrical plug connector 100 are partly exposed and in contact with the metallic shell 12, so that the ground leg 14 of the electrical plug connector 100 is provided for noise conduction and grounding of the electrical plug connector 100.

Based on the above, by the structural mating and size mating between the rear assembling portion of insulated housing and the buckling portion of the rear terminal organizer, the fixation between the rear assembling portion and the buckling portion can be further improved. As a result, the insulated housing would not detach from the rear terminal organizer easily when a bending test is applied to the electrical plug connector, and the tail portions of the upper-row plug terminals and the tail portions of the lower-row plug terminals would not detach from the through holes of the rear terminal organizer. Consequently, the fixing between the insulated housing and the rear terminal organizer and the structural strength of the electrical plug connector can be improved efficiently. Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell, defining a receiving cavity therein;

an insulated housing, received in the receiving cavity, the insulated housing comprising an upper portion, a lower portion, a mating room, and a rear assembling portion, wherein the mating room is defined at the front of the insulated housing and between the upper portion and the lower portion, the upper portion has an upper mating face, the lower portion has a lower mating face, the upper mating face is faced toward the lower mating face, and the rear assembling portion is defined at the rear of the insulated housing;

a plurality of upper-row plug terminals, held in the insulated housing and located upon the upper mating face of the upper portion, wherein the upper-row plug terminals comprise a plurality of pairs of upper signal pairs for signal transmission, at least one power terminal, and at least one ground terminal;

a plurality of lower-row plug terminals, held in the insulated housing and located upon the lower mating face of the lower portion, wherein the lower-row plug terminals comprise a plurality of pairs of lower signal pairs for signal transmission, at least one power terminal, and at least one ground terminal, wherein the upper-row plug terminals and the lower-row plug terminals have 180 degree symmetrical design with respect to a central point of the receiving cavity as the symmetrical center; and a rear terminal organizer, assembled to the rear of the insulated housing, the rear terminal organizer comprising:

a plurality of through holes, each defined through the rear terminal organizer from the front to the rear, wherein the rear of the upper-row plug terminals and the rear of the lower-row plug terminals respectively pass through the through holes; and a buckling portion, defined at the front of the rear terminal organizer, wherein the buckling portion is adapted to be mated and engaged with the rear assembling portion.

2. The electrical plug connector according to claim 1, wherein the width of the rear assembling portion is substantially equal to the width of the buckling portion, so that the rear assembling portion is mated with the buckling portion.

3. The electrical plug connector according to claim 1, further comprising a circuit board assembled to the rear of the rear terminal organizer, wherein the circuit board comprises a plurality of ground contacts connected to rear of the upper-row plug terminals and rear of the lower-row plug terminals.

4. The electrical plug connector according to claim 1, wherein each of the upper-row plug terminals comprises a flexible contact portion, a body portion, and a tail portion, wherein the body portion is held in the upper portion, the flexible contact portion is extended forward from the body portion in the rear-to-front direction and partly exposed upon the upper mating face of the upper portion, and the tail portion is extended backward from the body portion in the front-to-rear direction and protruded from the insulated housing.

5. The electrical plug connector according to claim 1, wherein each of the lower-row plug terminals comprises a flexible contact portion, a body portion, and a tail portion, wherein the body portion is held in the lower portion, the flexible contact portion is extended forward from the body portion in the rear-to-front direction and partly exposed upon the lower mating face of the lower portion, and the tail portion is extended backward from the body portion in the front-to-rear direction and protruded from the insulated housing.

6. The electrical plug connector according to claim 1, wherein the position of the upper-row plug terminals correspond to the position of the lower-row plug terminals.

7. The electrical plug connector according to claim 1, wherein the electrical plug connector is a USB Type-C electrical plug connector.

8. The electrical plug connector according to claim 1, wherein the rear assembling portion is a protruded block, the buckling portion is a recessed groove, and the protruded block is engaged in the recessed groove.

9. The electrical plug connector according to claim 8, wherein the width of the rear assembling portion is substantially equal to the width of the buckling portion, so that the rear assembling portion is mated with the buckling portion.

10. The electrical plug connector according to claim 8, wherein the buckling portion comprises a plurality of guiding inclined surfaces defined around the periphery of the recessed groove.

11. The electrical plug connector according to claim 10, wherein the width of the rear assembling portion is substantially equal to the width of the buckling portion, so that the rear assembling portion is mated with the buckling portion.

12. The electrical plug connector according to claim 1, wherein the rear assembling portion is an engaging groove, and the buckling portion is an engaging block, the engaging block is engaged in the engaging groove.

13. The electrical plug connector according to claim 12, wherein the width of the rear assembling portion is substantially equal to the width of the buckling portion, so that the rear assembling portion is mated with the buckling portion.

14. The electrical plug connector according to claim 1, wherein the rear terminal organizer further comprises at least one gluing passage formed at a peripheral area of the rear terminal organizer, and each of the gluing passage is defined through the rear terminal organizer from the front to the rear.

15. The electrical plug connector according to claim 14, wherein the gluing passage formed at sidewall of the rear terminal organizer.

16. The electrical plug connector according to claim 15, wherein the rear terminal organizer further comprises a plurality of gluing passages, the gluing passages respectively define groove structures, and the groove structures are located at two sides of the top surface of the rear terminal organizer and two sides of the bottom surface of the rear terminal organizer.

* * * * *